US007263739B2

(12) United States Patent
Boyer et al.

(10) Patent No.: US 7,263,739 B2
(45) Date of Patent: Sep. 4, 2007

(54) ROLLER FOR MOP

(75) Inventors: Christopher T. Boyer, Oak Park, IL (US); Miroslav Vuckovic, Skokie, IL (US)

(73) Assignee: Freudenberg Household Products LP, Northlake, IL (US)

( * ) Notice: Subject to any disclaimer, the term of this patent is extended or adjusted under 35 U.S.C. 154(b) by 109 days.

(21) Appl. No.: 10/937,527

(22) Filed: Sep. 9, 2004

(65) Prior Publication Data

US 2006/0048321 A1 Mar. 9, 2006

(51) Int. Cl.
*A47L 13/144* (2006.01)

(52) U.S. Cl. ..... 15/119.2; 15/262; 492/30; 492/33; 492/36

(58) Field of Classification Search ..... 15/116.1, 15/116.2, 119.1, 119.2, 262; 492/28, 30, 492/33, 34, 36

See application file for complete search history.

(56) References Cited

U.S. PATENT DOCUMENTS

| | | | | |
|---|---|---|---|---|
| 429,048 | A * | 5/1890 | McDonnel | 15/119.1 |
| 1,783,879 | A * | 12/1930 | Tujague et al. | 15/119.1 |
| 1,855,218 | A * | 4/1932 | Cyrill | 15/119.2 |
| 3,008,163 | A | 11/1961 | Bommer | |
| 4,196,488 | A | 4/1980 | Barry | |
| 4,333,198 | A | 6/1982 | Vosbikian | |
| 5,455,978 | A | 10/1995 | Graham | |
| D410,783 | S | 6/1999 | Camp, Jr. et al. | |
| 6,000,087 | A | 12/1999 | Petner | |
| 6,026,530 | A | 2/2000 | Camp, Jr. | |
| 6,055,696 | A | 5/2000 | Lin | |
| RE37,415 | E | 10/2001 | Petner | |
| 6,785,927 | B2 | 9/2004 | Lesley et al. | |
| 2003/0115700 | A1 | 6/2003 | Lesley et al. | |

FOREIGN PATENT DOCUMENTS

| | | |
|---|---|---|
| GB | 2 200 537 A | 8/1988 |
| WO | WO 2004/062456 A2 | 7/2004 |

* cited by examiner

*Primary Examiner*—Mark Spisich
(74) *Attorney, Agent, or Firm*—Leydig, Voit & Mayer, Ltd.

(57) ABSTRACT

The cleaning implement includes a shaft having an operator end and a cleaning end, a mop head comprising a liquid-absorbent material and a wringing mechanism. The mop head and the wringing mechanism are movable relative to one another between at least a cleaning position and a plurality of wringing positions. The wringing mechanism includes a roller which compresses at least a portion of the liquid-absorbent material to thereby expel liquid therefrom. The plastic roller has a plurality of spaced ribs defining cavities therebetween. The ribs are complementally shaped and dimensioned to allow rolling contact relative to the liquid absorbent material as travel takes place between the cleaning position and a wringing position.

32 Claims, 12 Drawing Sheets

ROLLER FOR MOP

FIELD OF THE INVENTION

The invention is in the field of cleaning implements. In one embodiment, the invention is directed toward a roller mop utilizing a ringer having an integrally molded pair of rollers.

BACKGROUND OF THE INVENTION

Numerous cleaning implements for applying and removing liquid to and from a floor have been provided in the prior art. One well-known type of such cleaning implement is a roller mop, which generally comprises a mop head made of a natural or synthetic sponge material connected to the end of a shaft. Roller mops further include a wringer, which typically comprises a pair of rollers and an actuating mechanism. The rollers may be either affixed to the shaft or movable with respect thereto such that the rollers and the mop head typically are movable with respect to each other over a range of travel between a cleaning position and wringing positions. In the cleaning position, the cleaning implement may be used to apply liquid to a surface, such as, a wall or floor, or to remove liquid therefrom, and in the wringing positions, liquid is expellable from the mop head.

The prior art has provided numerous straight head and angle head roller mops, an "angle head" roller mop being one in which the mop head is disposed at an oblique angle with respect to a longitudinal axis of the shaft. Of the two types, straight head mop heads generally are less convenient for cleaning in that the operator generally is most comfortable positioning the shaft of the cleaning implement at an oblique angle with respect to the floor. It is believed that angle head mop heads are more satisfactory for applying or removing liquid from a floor. However, it has been observed that many prior art roller mop wringing mechanisms are not entirely satisfactory.

Various configurations have been used for the rollers used in the wringers of such roller mops. One approach uses integrally formed rollers such as shown in FIG. 15 of U.S. patent application Ser. No. 10/027,674 filed on Dec. 20, 2001 listing the inventors as Paul M. Lesley and Paul B. Specht. Another approach utilizes a plurality of roller portions through which an axle extends. The roller portions can include axial serrations around the surfaces to increase the gripping purchase of each roller upon the mop head during a wringing operation. The multiple roller portion construction can facilitate mounting the roller to the bearings of the channel body used in the wringer, as shown in U.S. patent application Ser. No. 10/755,726 filed on Jan. 12, 2004 listing the inventors as Paul B. Specht and Paul M. Lesley.

It would be desirable to provide rollers which can be integrally formed in configurations that minimize the amount of material used while also achieving enhanced quality control. It would also be desirable to provide integrally-formed rollers of novel configurations for use in cleaning implements.

BRIEF SUMMARY OF THE INVENTION

In accordance with the invention, a cleaning implement having a shaft, a mop head, and a wringing mechanism is provided. The mop head can be disposed at an oblique angle with respect to the longitudinal axis of the shaft. The mop head is movable relative to the wringer over a range of travel at least between a cleaning position and a plurality of wringing positions. The wringing mechanism and the wringing positions compresses at least a portion of the liquid-absorbent material of the mop head so as to expel liquid therefrom. Pursuant to the present invention, the wringer comprises at least one, and preferably two, plastic rollers, each integrally molded, and having a channel body for supporting, when two are used, the rollers in spaced relationship with each other such that a channel is defined therebetween. Each roller includes a plurality of spaced ribs defining cavities which are open so as to accommodate, in the one embodiment, penetration by the liquid-absorbent member. The ribs are complementally dimensioned to allow the ribs to contact the liquid-absorbent material as the ringer travels between the cleaning position and the wringing positions. In some of the embodiments, movement of the mop head relative to the wringer during the range of travel between the cleaning position and the plurality of wringing positions causes liquid-absorbent material to penetrate into the open cavities, thereby enhancing the gripping purchase of the rollers.

Features of the present invention will become apparent to one of ordinary skill in the art upon reading the detailed description, in conjunction with the accompanying drawings, provided herein.

BRIEF DESCRIPTION OF THE DRAWINGS

In these descriptions, the terms "top," "bottom" and the like are for convenient reference only and should not be construed as limiting because in practice the cleaning implement may be oriented omnidirectionally.

DETAILED DESCRIPTION OF THE INVENTION

Figure 1:
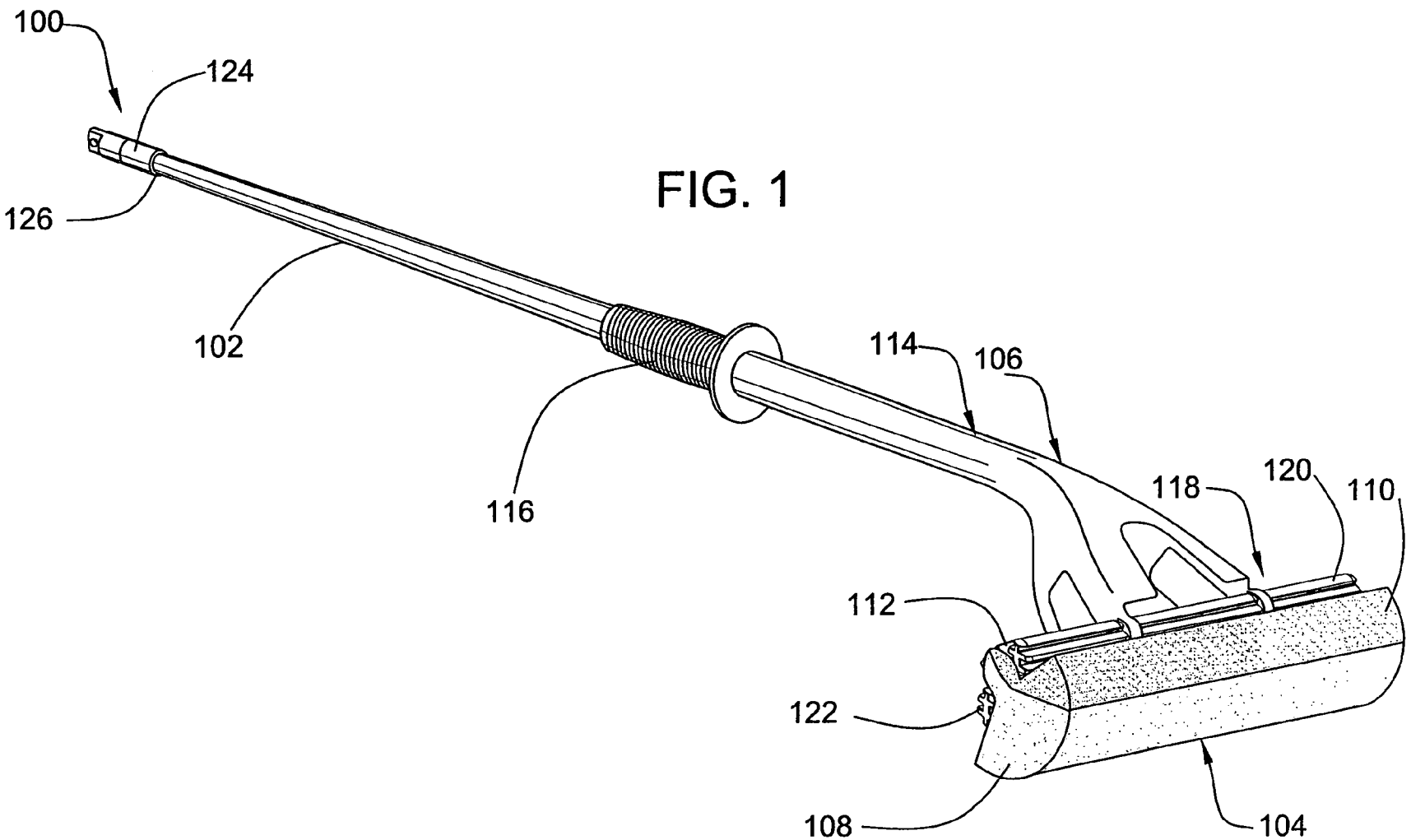
FIG. 1 is a perspective view of a cleaning implement according to the present invention.
Figure 2:
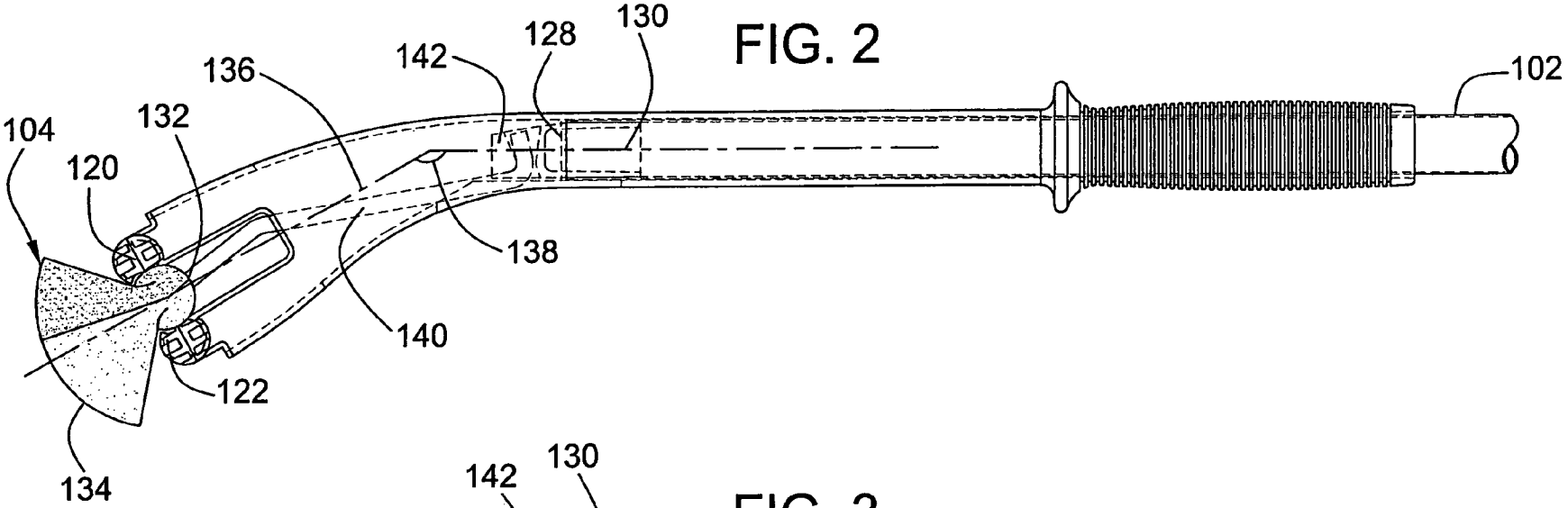
FIG. 2 is a side elevational view of the cleaning implement as shown in FIG. 1 when the mop head is in a cleaning position.
Figure 3:
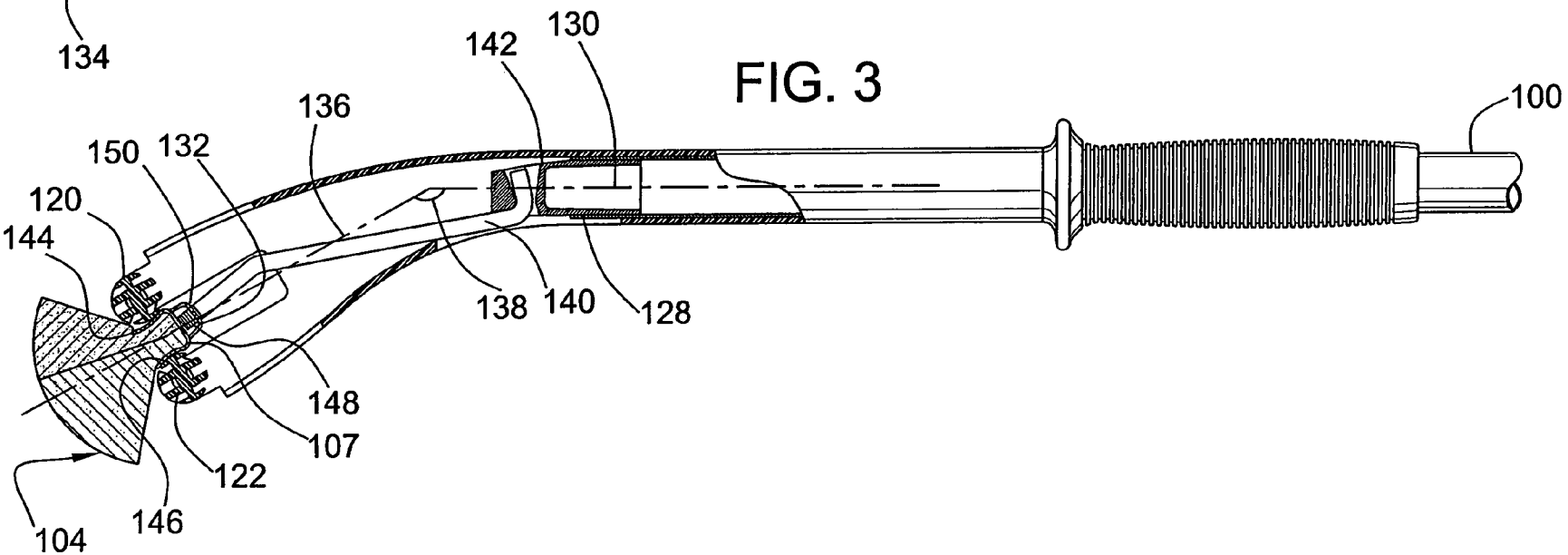
FIG. 3 is a side elevational view, partially broken away, of the cleaning end of the cleaning implement shown in FIG. 2.
Figure 4:
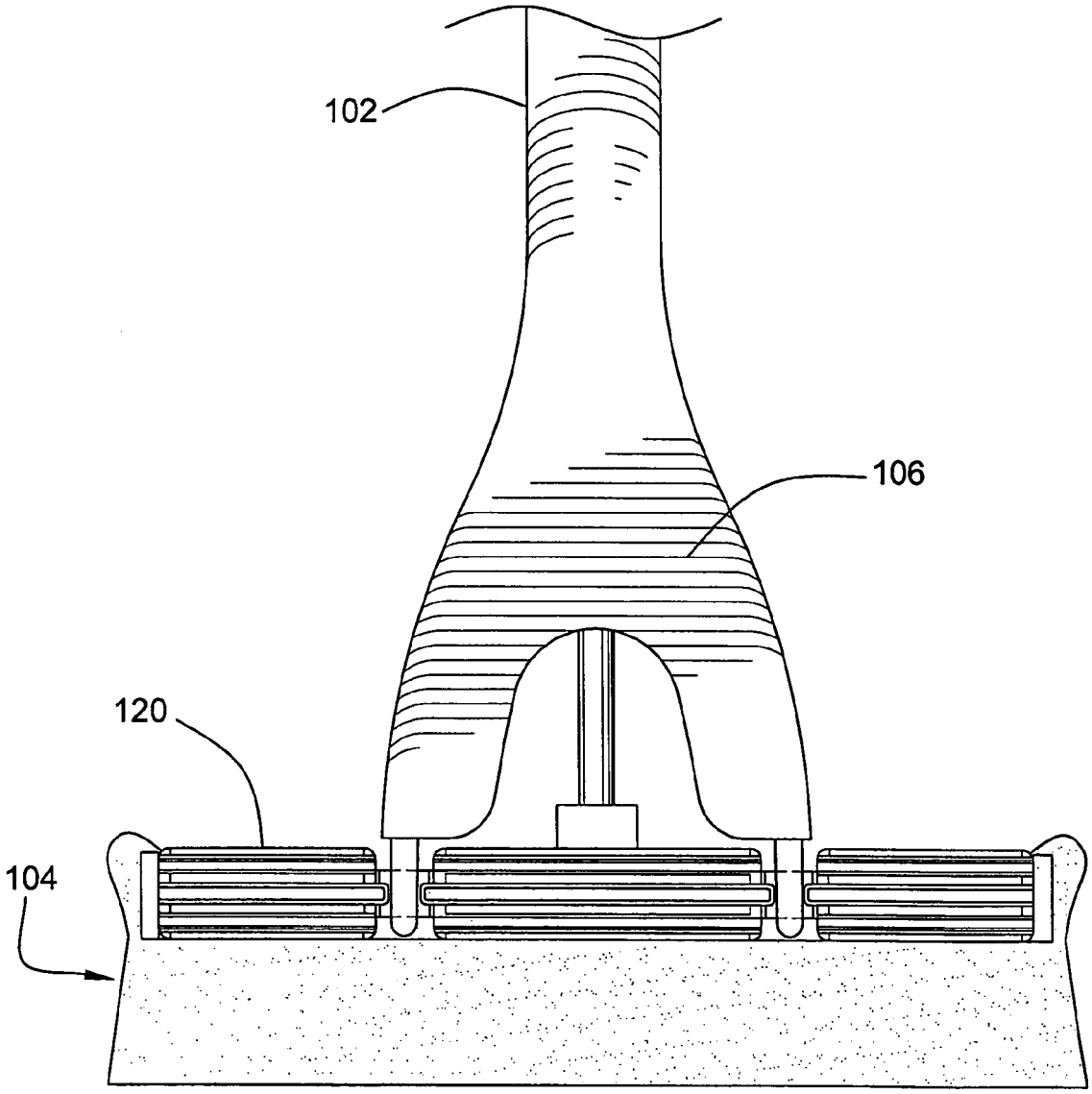
FIG. 4 is a rear elevational view of the cleaning end of the cleaning implement shown in FIGS. 1-3, with the mop head in a cleaning position.

FIG. 1 shows one embodiment of a cleaning implement 100 of the present invention. The cleaning implement 100 generally includes a shaft 102, a mop head 104 and a wringing mechanism 106. The mop head 104 is composed of a liquid absorbent material, which preferably is a synthetic sponge material. In the illustrative embodiment, the liquid absorbent material is composed of a first portion 108 and a second portion 110. The second portion 110 of the liquid absorbent material is abrasive relative to the first portion. The mop head 104 further includes a retainer clip 112, which, in effect, pinches the ends of the first and second portions 108 and 110 to thereby form the mop head, as seen in FIGS. 2 and 3. The mop head of the cleaning implement 100 may be similar to the mop head shown and described in U.S. Pat. No. Re. 35,005 to Torres, reissued Aug. 1, 1995, which is incorporated herein by reference in its entirety.

The wringing mechanism comprises a wringer 114, which includes an operator gripping portion 116 and a wringing portion 118. In the illustrative embodiment, the operator gripping portion 116 is configured as a gripping handle, and a wringing portion 118 is configured as a pair of rollers 120, 122. A hanging cap 124 is disposed at the operator end 126 of the shaft 102. As best seen in FIGS. 2 and 3, the operator end of the shaft 102 defines a longitudinal axis indicated at 130. Generally, the mop head 104 includes a connecting side 132 and a cleaning side 134 which define a mop head axis 136. The mop axis 136 is disposed at an oblique angle with respect to the longitudinal axis 130 of the shaft 102 as indicated at 138.

The cleaning implement 100 further includes a connecting link 140, which is shown as a rigid member connected to the shaft 102 via a connector 142. The rollers 120, 122 rest in channels 144, 146, formed by curved portions of the clip 112 of the mop head 104, thereby inhibiting relative axial movement of the rollers 120, 122 and mop head 104. The connecting link 140 may be connected to the mop head 104 via screw threads 148 received by the threaded portion 150. In other embodiments, the connecting link may be connected to the mop head via a hook portion on the connecting link engaging a metal loop on the mop head.

Figure 5:
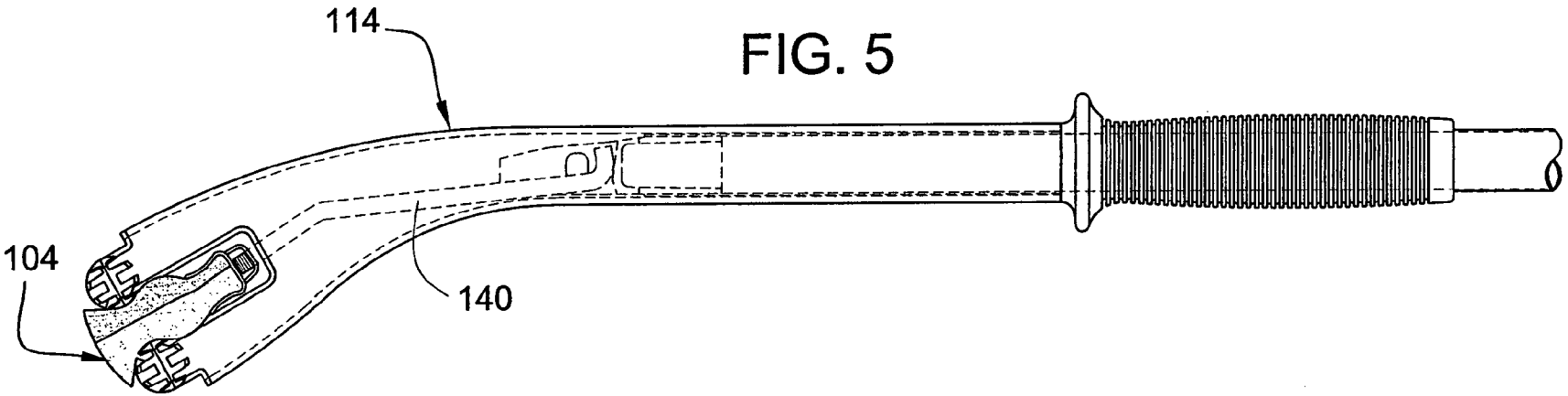
FIG. 5 is a side elevational view of the cleaning implement shown in FIG. 1, shown when the mop head is in the fully retracted position.
Figure 6:
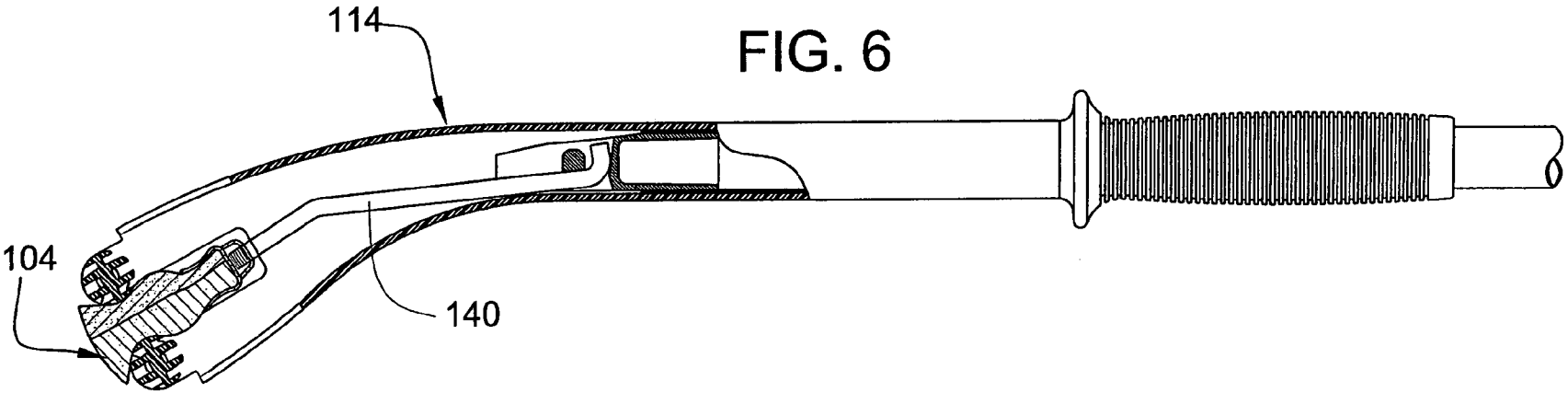
FIG. 6 is a side elevational view, partially broken away, of the cleaning end of the cleaning implement when the head is in the position shown in FIG. 5.
Figure 7:
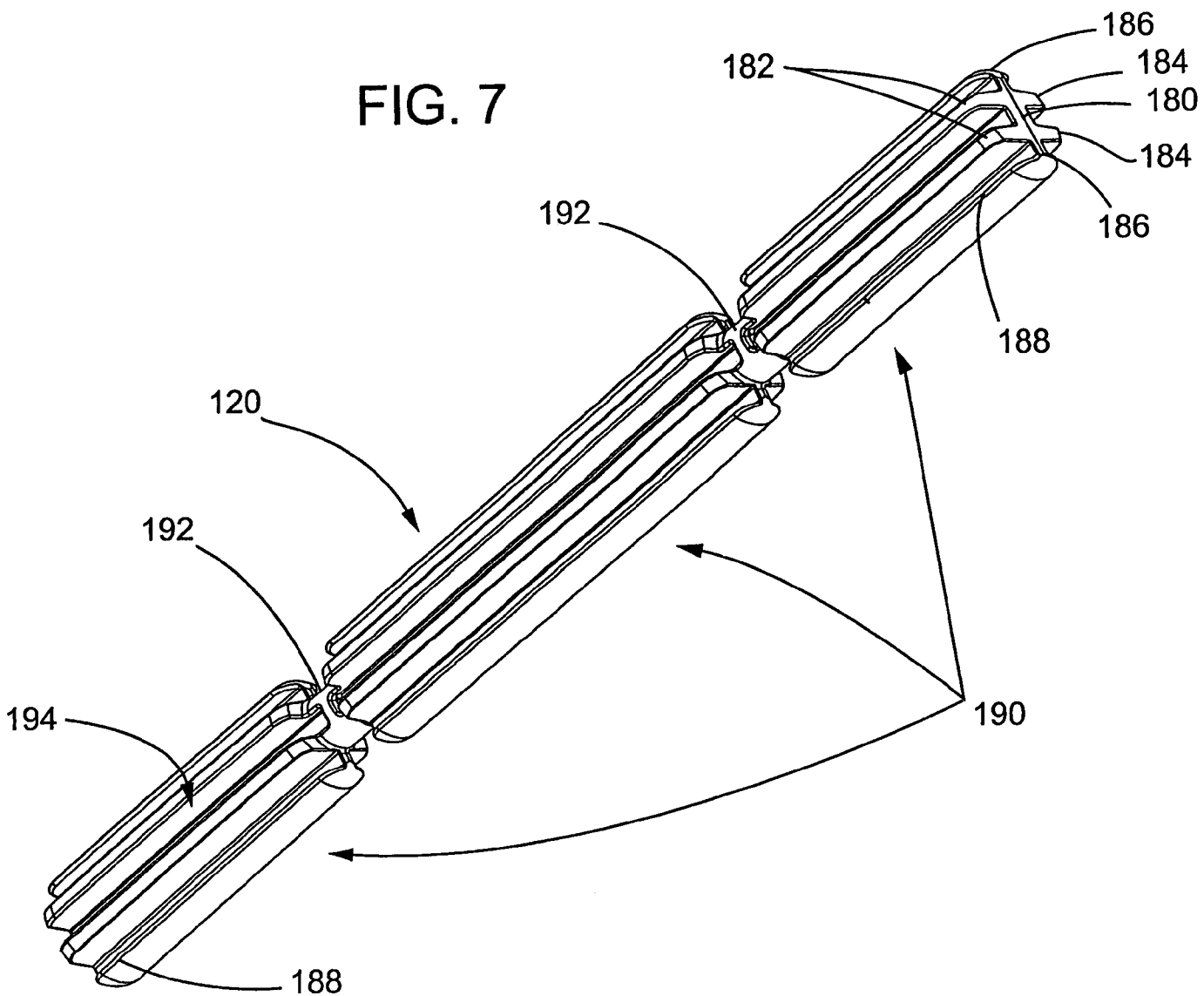
FIG. 7 is a perspective view of a first embodiment of an integrally molded roller of the present invention for use in the cleaning implement shown in FIG. 1.
Figure 9:
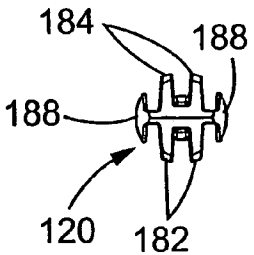
FIG. 9 is a side view of the roller shown in FIG. 7.

Operation of the cleaning implement 100 to wring the mop head 104 is, in general, accomplished by gripping the shaft 102 and the operator gripping portion 116 of the wringer 114, and then manually moving the wringer 114 with respect to the shaft 102. In FIGS. 2 and 3, the mop head 104 is shown in the cleaning position. FIGS. 5 and 6 illustrate the mop head 104 in its fully retracted position after having moved through a series of wringing positions.

In accordance with the present invention, novel rollers are utilized which are integrally molded and include a plurality of spaced ribs defining cavities which are open. By utilizing integrally molded plastic rollers, significant economies can be achieved while also enhancing the performance. Utilizing ribbed rollers thus minimizes the amount of material required for the rollers and obviates quality control issues such as warping which can occur by using previously-configured rollers.

The rollers utilized in the present invention can be made by known injection molding techniques. Indeed, the integrally formed rollers can be molded by any desired technique.

In accordance with one embodiment of the present invention, the spaced ribs are disposed transversely to the mop head axis 136, i.e., the ribs extend longitudinally across the length of the rollers 120, 122. The spaced ribs are complementally dimensioned with respect to the liquid-absorbent member so as to allow a portion of the cavities to accommodate penetration by the liquid-absorbent member as the wringer travels between the cleaning position and the several wringing positions. In this fashion, slippage can be minimized, and the gripping purchase enhanced.

Figure 12:
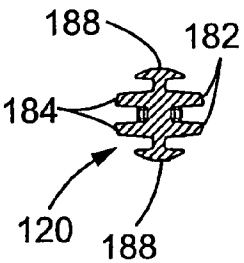
FIG. 12 is a cross-sectional view taken generally along lines 12-12 of FIG. 11.
Figure 8:
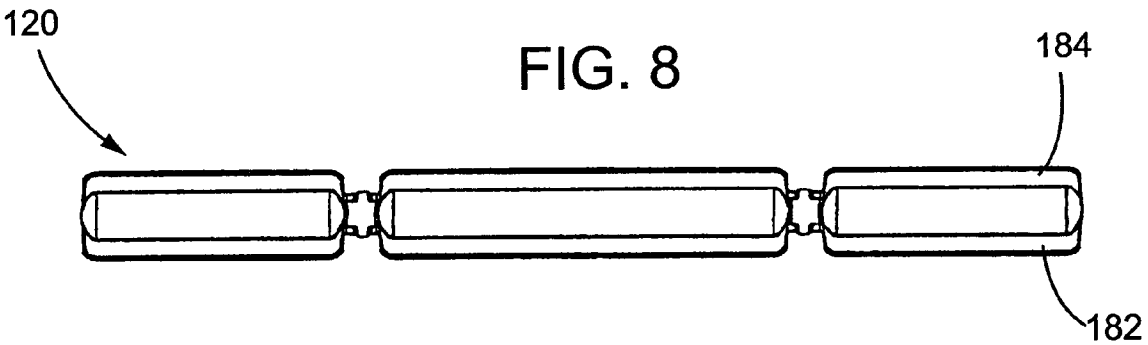
FIG. 8 is a front elevational view of the roller shown in FIG. 7.
Figure 10:
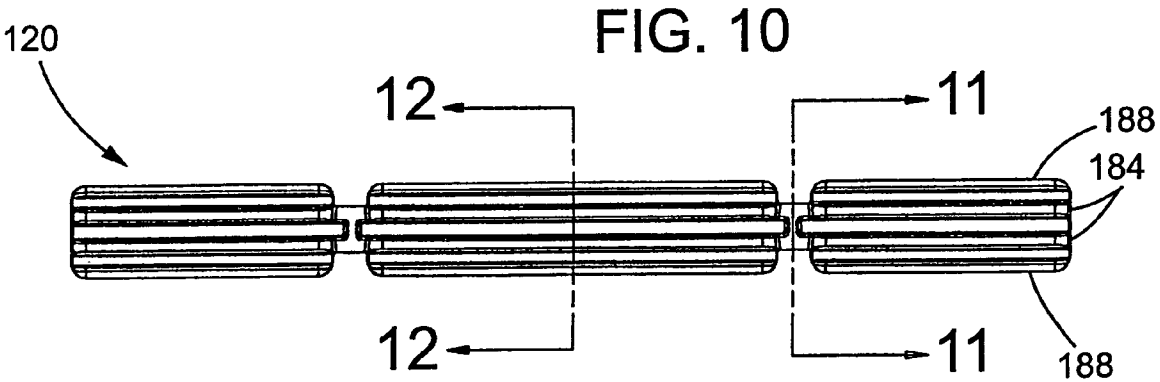
FIG. 10 is a top elevational view of the roller shown in FIG. 7.
Figure 11:
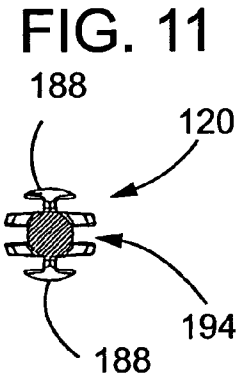
FIG. 11 is a cross-sectional view taken generally along lines 11-11 of FIG. 10.

FIGS. 7-12 show one embodiment for at least one, and preferably both, of the rollers 120, 122. As shown therein, the roller 120 comprises a base member 180 having upstanding ribs 182 extending upwardly from the base member 180 and ribs 184 extending downwardly from the base member. The ends 186 of base member 180 extend beyond the outer face of the ribs 182 and 184 and, in this embodiment include ribs 188 which have a dome-shaped outer surface so as to facilitate rotation of the rollers 120, 122 together with the height of the ribs 188 relative to that of ribs 182 and 184 (as best seen in FIGS. 11 and 12. As is also best seen in FIGS. 11 and 12, the ribs 182, 184 together with the portion of the base member 180 located between such ribs provides an H-shaped configuration for the rollers, augmented by the ends 186 of the base member defining the outer periphery of the rollers. Such a configuration minimizes the amount of material required to make the rollers while achieving an adequately robust roller which should have minimal, if any, warping.

The rollers 120, 122 are integrally molded to provide segments 190 having generally circular sections 192 for rotatable connection with the wringing mechanism 106 (as best seen in FIG. 1).

As may be appreciated by reference to FIGS. 1-3, the spaced ribs 182, 184 in this embodiment extend longitudinally along the length of these rollers. The ribs are thus disposed generally transversely to the mop axis 136.

This embodiment maintains a relatively nominal (i.e. constant) wall section or thickness throughout the part. For injection molding of a plastic part, a nominal wall section is ideal for reducing warpage, built-in stress, and maintaining structural integrity of the part. During the cooling process of the injection molding, a nominal wall section will cool much more rapidly and consistently, thus achieving a faster machine cycle time.

This embodiment also uses less material than solid embodiments due to the reduction of the mass of plastic used for the rollers. For example, this reduction of mass can be in the range of 10-60% or in the range of 40-50% over solid mass embodiments. Furthermore, this reduction of mass can constitute a reduction of the cost to make the rollers.

The reduced injection molding cycle time and reduction of mass provide a roller at a reduced cost.

Further, as will be discussed hereinafter, the spaced ribs allow the liquid-absorbent material to penetrate into the open cavities as the rollers are rotated from the cleaning position through the plurality of wringing positions. In this fashion, a sliding action during this movement is minimized, if not eliminated, due to the enhanced gripping purchase thereby created.

The penetration of the liquid absorbent material into the open cavities, indicated generally at 194, can be regulated, as is desired. It is not necessary for the liquid absorbing material to entirely fill the cavities 194. It is sufficient to complementally dimension the ribs and spacing relative to the liquid absorbent material so that the liquid absorbent material is, in effect, pinched between adjacent ribs as the travel occurs through the wringing positions so as to distend the liquid-absorbent material, thereby forcing the liquid absorbent material to penetrate into the open cavities a sufficient depth to provide the desired enhanced gripping purchase.

Figure 13:
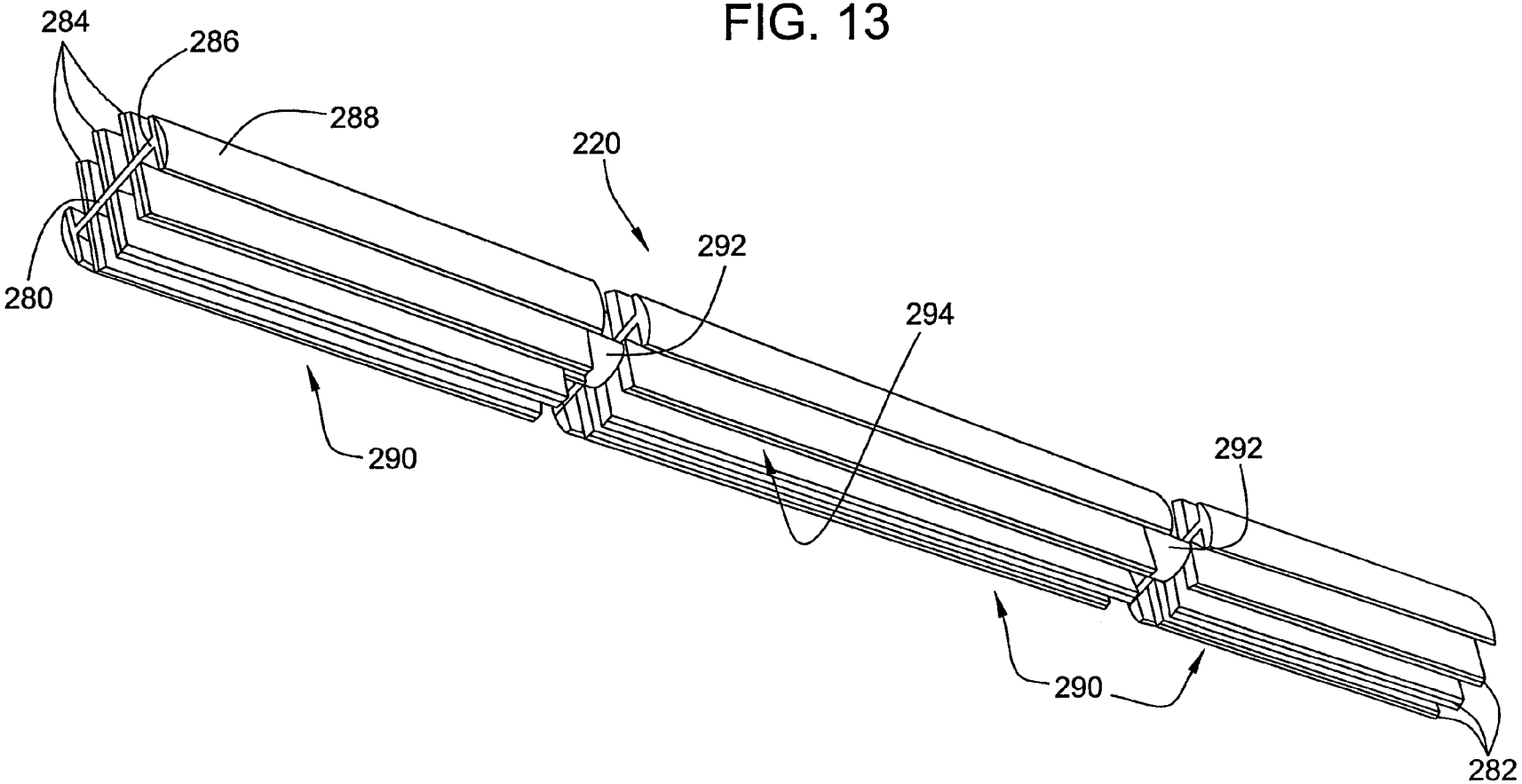
FIG. 13 is a perspective view of a second embodiment of the roller for use in the cleaning implement of FIG. 1.

FIGS. 13-16 show still other embodiments which may be utilized for the integrally molded rollers of the present invention. In these embodiments, the elements which are the same as the components of the first embodiment are similarly numbered. Thus, for example, the base member 180 of roller 120 in the embodiment illustrated in FIG. 13 is identified as base 280.

In the embodiment shown in FIG. 13, the roller 220 is similar to the first embodiment, except that three ribs extend on each of the top and bottom surfaces of the base member. Thus, base member 280 has three spaced ribs extending outwardly therefrom on the top with three similarly dimensioned ribs 284 extending from the bottom surface of the base member 280. As was the case in the first embodiment, the ends 286 of the base member 280 extend past the outer surface of the outermost ribs 282, 284. Also, as with the first embodiment, the ends 286 are molded with upstanding ribs 288 having the outer surface thereof being dome-shaped to facilitate the rolling action as the cleaning element moves through the several wringing positions. Likewise, the roller 220 is divided into molded segments 290 having connection portions 292 for fitting into the cleaning head of the implements.

As was also the case with the first embodiment, the roller 220 has open cavities 294 which can enhance the gripping purchase of the rollers during movement through the wringing positions.

Figure 14:
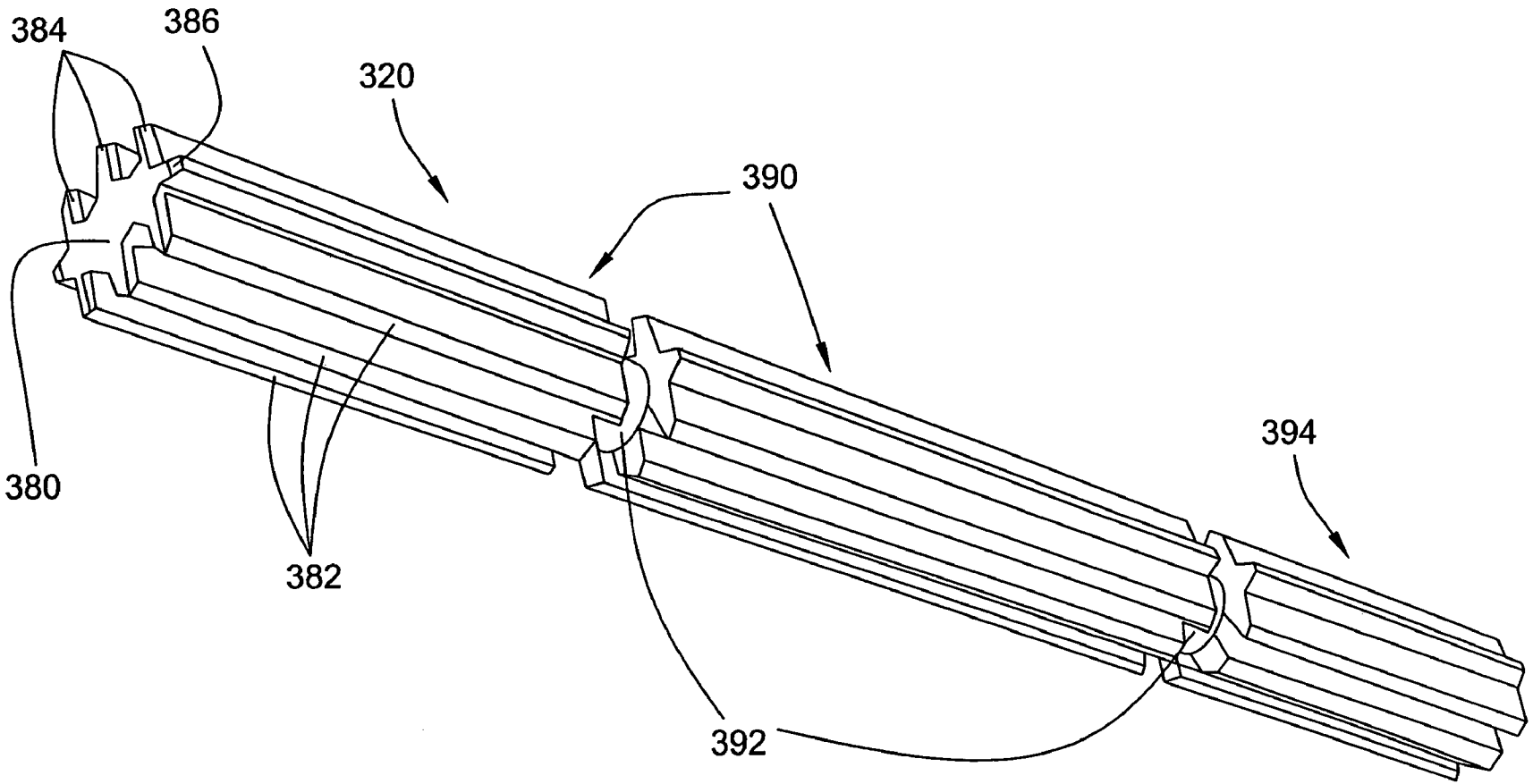
FIG. 14 is a third embodiment of a roller for use in the cleaning implement of FIG. 1.

The roller embodiment shown in FIG. 14 is generally identical with the second embodiment illustrated in FIG. 13, except that the ends of the base member terminate without the inclusion of molded ribs. Thus, as seen in FIG. 14, the roller 320 includes a base member 380 having three upstanding spaced ribs 382 and three downwardly extending spaced ribs 384. The base member 380 terminates in ends 386. As with the prior embodiments, the molded roller 320 has three segments 390 with generally cylindrically-shaped portions 392 for attachment to the cleaning implement, as before. The spaced ribs 382, 384, likewise provide spaced open cavities 394.

Figure 15:
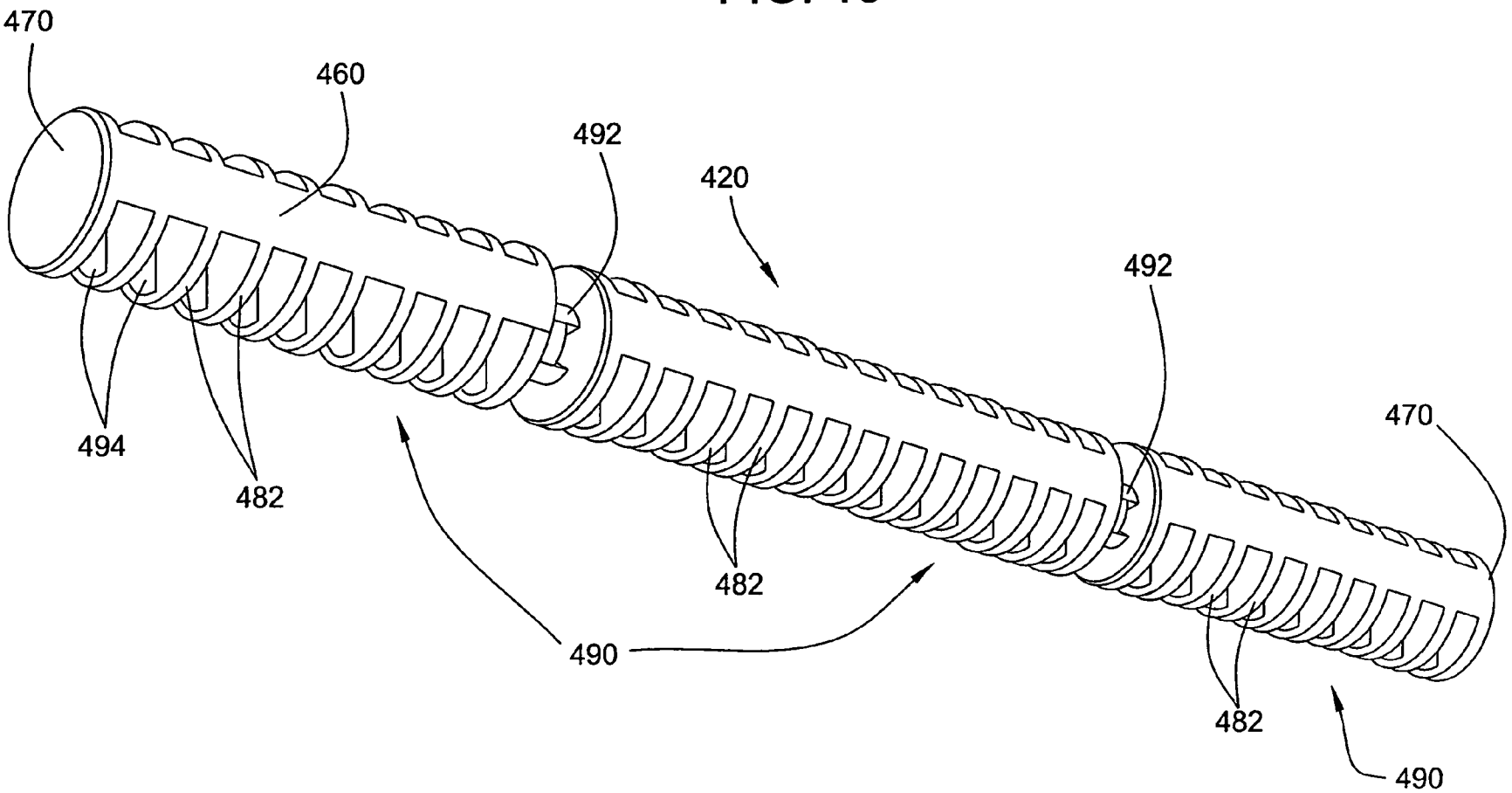
FIG. 15 a fourth embodiment of a roller for use in the cleaning implement of FIG. 1.
Figure 16:
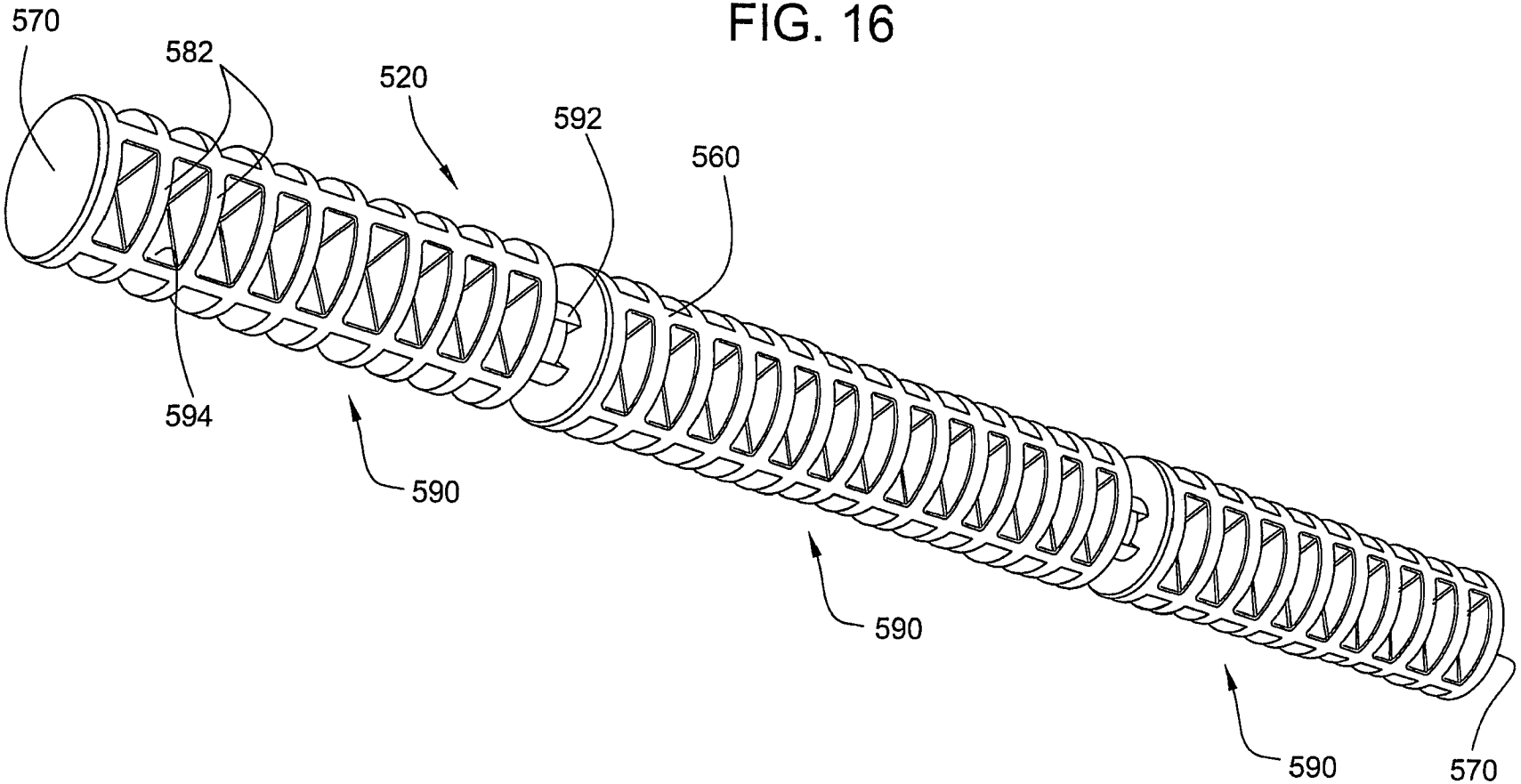
FIG. 16 is a fifth embodiment of a roller for use in the cleaning implement of FIG. 1.

Further embodiments for the rollers used in the cleaning implements of the present invention are illustrated in FIGS. 15 and 16. In these embodiments, the ribs are spaced transversely along the longitudinal dimension of the rollers. In the embodiment shown in FIG. 15, the roller 420 includes a member 460 located around a portion of the periphery of the roller 420 and extending longitudinally across the roller terminating in end caps 470, as is shown. A series of spaced ribs 482 are provided, extending about the periphery of the roller and from member 460, as is shown. As was the case with the other embodiments, the roller 420 includes three segments 490, defined by generally circularly-shaped members 492. As was the case with the prior embodiments, the ribs 482 define a plurality of spaced open cavities 494.

In the embodiment shown in FIG. 16, the integrally molded roller 520 is configured similarly to the embodiment of FIG. 15. Thus, the ribs are positioned transversely to the longitudinal dimension of the roller. As is thus illustrated in FIG. 16, the periphery of the roller 520 has a portion 560 extending about the periphery of the roller and which terminates in end caps 570. Again, the roller 520, as in prior embodiments, is divided into three segments 590 by generally circularly shaped portions 592 so as to allow attachment to the cleaning implement shown in FIGS. 1-6. Further, the ribs 582 define therebetween a plurality of cavities 594.

Figure 17:
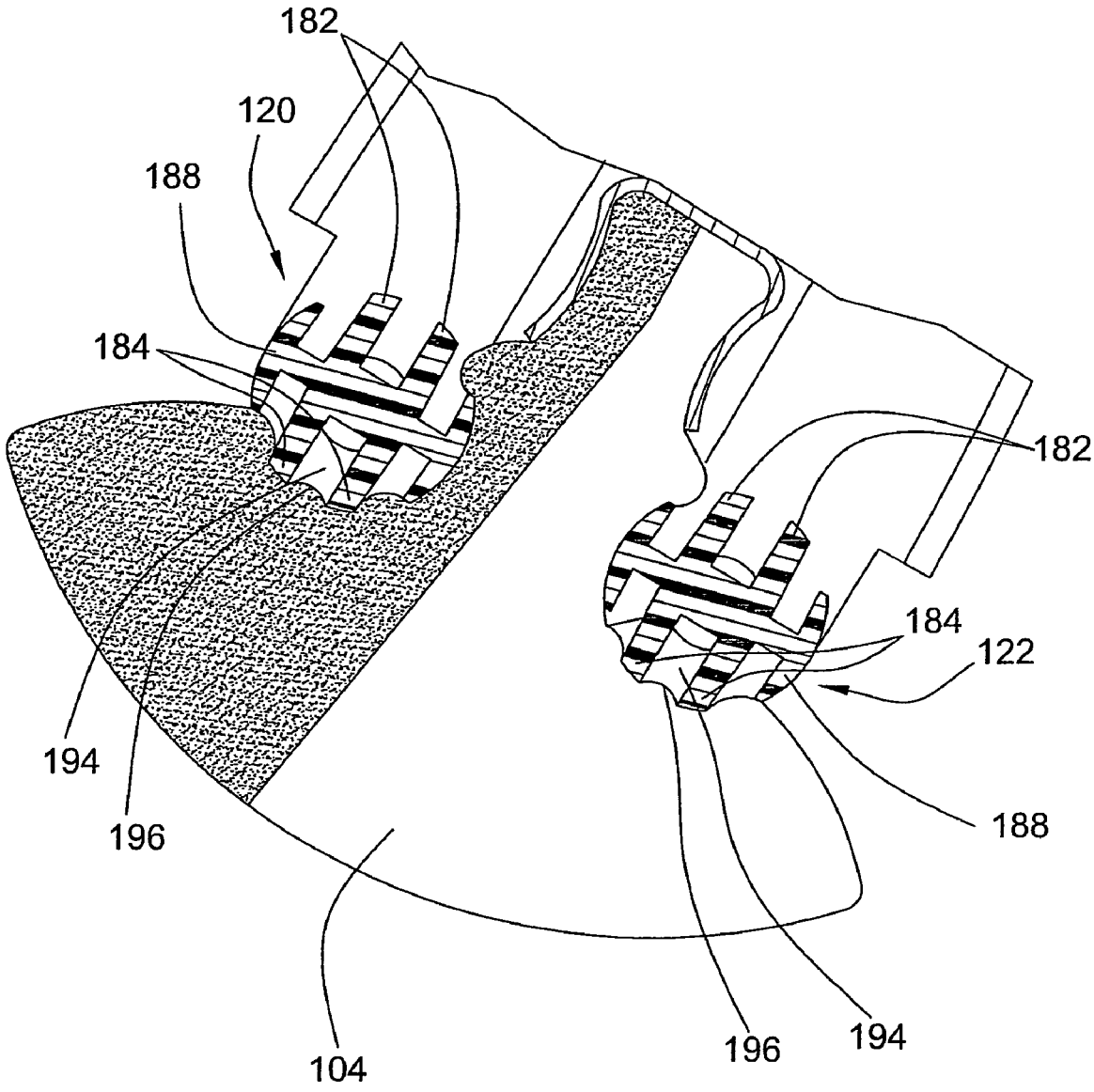
FIG. 17 is a cross-sectional view of the cleaning end of the cleaning implement of FIG. 1 and showing the penetration into the open cavities of the roller shown in FIG. 7 by liquid-absorbent material when the mop head is in a wringing position.

FIG. 17 shows the enhanced gripping purchase which may be achieved using, as an illustrative example, the first embodiment of this invention, as shown in FIGS. 7-12. As seen, when the roller 120 is in one of the several wringing positions, the liquid-absorbent material (either the portion 108 or 110) is pinched between adjacent ribs (either 182 or ribs 184). In this fashion, the liquid absorbent material penetrates into the cavities 194 as generally indicated at 196. This is believed to minimize, if not eliminate, any sliding action as movement through their wringing positions is carried out, while enhancing the gripping purchase. In this fashion, the efficiency of the wringing operation is similarly enhanced.

Figure 18:
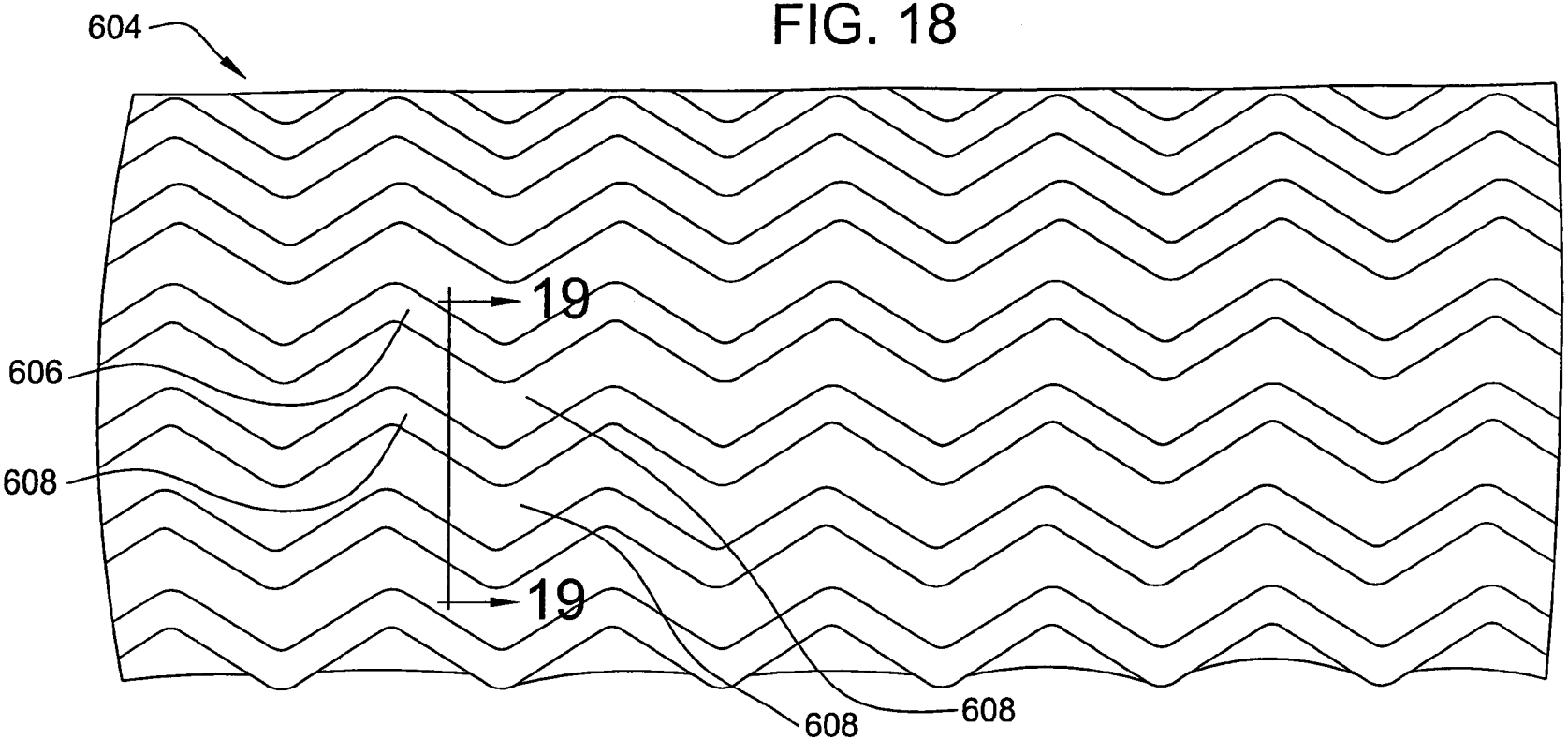
FIG. 18 is a plan view of a cleaning side of a mop head suitable for use in the cleaning implement of the present invention.
Figure 19:
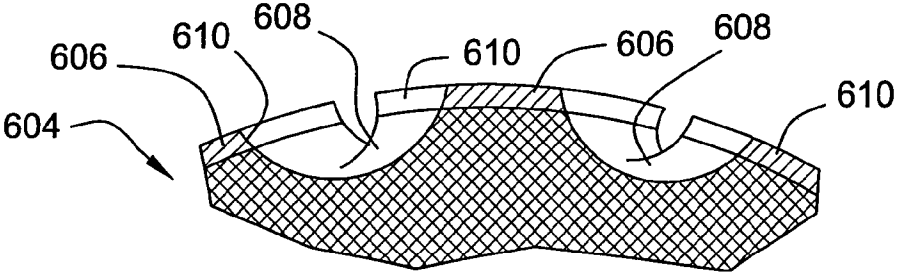
FIG. 19 is a fragmentary, cross-sectional view of the mop head of FIG. 17 taken generally along the lines 19-19 of FIG. 18.

FIGS. 18 and 19 show one embodiment of the mop head suitable for use in the present invention. To this end, the mop head 604 includes, on its cleaning side, a plurality of alternating lands 606 and valleys 608 defined therein. The lands 606 and valleys 608 give the cleaning side a striated appearance. Each land 606 and valley 608 can have a generally saw-toothed shape. Further, as seen in FIG. 19, each land 606 and valley 608 can include an outer layer 610 of material that is different than the remainder of the material of the mop head sponge. Preferably, the layer 610 can be of a reticulated material, even more preferably an open-cell filter foam, and even, more preferably, a Foamex Protecpaire polyether polyurethane foam thermally reticulated material made by Foamex International of Eddystone, Pa. Similarly, it is suitable to provide the outer layer of the lands made of a material that is more abrasive than the remainder of the material of the mop head sponge.

In other embodiments, the roller may include longitudinal ribs around the periphery of the roller in the range of 3 ribs to 20 ribs or more depending upon the size of the roller. Similarly, in other embodiments, the roller may include transverse ribs in the range of 3 ribs to 50 ribs or more depending upon the size of the roller.

The components of the cleaning implement of the present invention may be made as conventional materials and assembled in a conventional manner. For instance, the wringer, connector, rollers and hanger cap preferably are made of a plastic material, such as polypropylene for the wringer, the rollers, and the hanger cap and an acetyl resin for the connector, as solely illustrative examples. Delrin® acetyl resin made by DuPont Engineering polymers of Wilmington, Del., is a specific example of a suitable acetyl resin for the connector. The shaft preferably comprises a hollow tube made of a thin gauge steel tubing. The connecting link can be made either from steel, aluminum, or any other material. Exemplary materials for the liquid absorbing material forming the mop head have been previously discussed herein.

Thus, it is seen that the invention provides novel, integrally molded rollers and a cleaning implement utilizing such rollers wherein the rollers have spaced ribs providing open cavities. In practice, the cleaning implement may include one or more of the features discussed herein, or all of said features. Other configurations for mops are possible as known in the art and also as noted above.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cleaning implement comprising:

a shaft having an operator and a cleaning end, the operator end and the cleaning end defining a longitudinal axis;

a mop head comprising a liquid-absorbent member;

a wringing mechanism comprising an operator-gripping portion and a wringer, the wringer being disposed at the cleaning end of the shaft, the mop head being movable relative to the wringer over a range of travel at least between a cleaning position and a plurality of wringing positions, the wringing mechanism in the wringing position compressing at least a portion of the liquid-absorbent member whereby liquid is expellable therefrom; said wringer comprising at least one integrally molded plastic roller, and a channel body for supporting the roller, said integrally molded plastic roller having a plurality of spaced ribs defining cavities therebetween and complementally shaped and dimensioned to allow rolling contact relative to said liquid-absorbent material as travel takes place between the cleaning position and the wringing positions wherein at least four ribs of the roller, together with a base member of the roller, provide an H-shaped configuration.

2. The cleaning implement according to claim 1 wherein said integrally molded plastic roller has a longitudinal dimension and said ribs are disposed in the longitudinal dimension.

3. The cleaning implement according to claim 1 wherein said ribs are dimensioned to allow penetration into the cavities by said liquid-absorbent material as travel takes place between the cleaning position and a wringing position.

4. The cleaning implement according to claim 1 wherein said base member has a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions.

5. The cleaning implement according to claim 4 wherein each end of the base member includes at least one said rib that is an end rib configured and dimensioned relative to the upstanding ribs on the top and bottom surfaces of said base member so as to facilitate a rolling action as travel takes place between the cleaning position to the plurality of wringing positions.

6. The cleaning implement according to claim 5 wherein the end ribs each have an outer dome-shaped surface contacting said liquid-absorbent material as travel takes place from the cleaning position to the plurality of wringing positions.

7. The cleaning implement according to claim 1 wherein the base member has top and bottom surfaces and each of the top and bottom surfaces of the base member have three said ribs that are upstanding ribs.

8. The cleaning implement according to claim 1 wherein the integrally molded roller has a longitudinal dimension, and said ribs are disposed transversely to the longitudinal dimension.

9. The cleaning implement according to claim 8 wherein said roller includes land areas extending in the longitudinal dimension, said land areas intersecting the transversely extending ribs and defining therebetween the cavities.

10. A cleaning implement comprising:

a shaft having an operator and a cleaning end, the operator end and the cleaning end defining a longitudinal axis;

a mop head comprising a liquid-absorbent member;

a wringing mechanism comprising an operator-gripping portion and a wringer, the wringer being disposed at the cleaning end of the shaft, the mop head being movable relative to the wringer over a range of travel at least between a cleaning position and a plurality of wringing positions, the wringing mechanism in the wringing position compressing at least a portion of the liquid-absorbent member whereby liquid is expellable therefrom; said wringer comprising a pair of plastic rollers, at least one of which is integrally molded, and a channel body for supporting the rollers in spaced relationship with each other such that a channel is defined therebetween, said integrally molded plastic roller having a plurality of spaced ribs defining cavities therebetween and complementally shaped and dimensioned to allow rolling contact relative to said liquid-absorbent material as travel takes place between the cleaning position and the wringing positions wherein at least four ribs of the roller, together with a base member of the roller, provide an H-shaped configuration.

11. The cleaning implement according to claim 10 wherein said integrally molded plastic roller has a longitudinal dimension and said ribs are disposed in the longitudinal dimension.

12. The cleaning implement according to claim 10 wherein both of said rollers are integrally molded.

13. The cleaning implement according to claim 10 wherein said ribs are dimensioned to allow penetration into the cavities by said liquid-absorbent material as travel takes place between the cleaning position and a wringing position.

14. The cleaning implement according to claim 10 wherein said base member has a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions.

15. The cleaning implement according to claim 14 wherein each end of the base member includes at least one said rib that is an end rib configured and dimensioned relative to the upstanding ribs on the top and bottom surfaces of said base member so as to facilitate a rolling action as travel takes place between the cleaning position to the plurality of wringing positions.

16. The cleaning implement according to claim 15 wherein the end ribs each have an outer dome-shaped surface contacting said liquid-absorbent material as travel takes place from the cleaning position to the plurality of wringing positions.

17. The cleaning implement according to claim 10 wherein the base member has top and bottom surfaces and each of the top and bottom surfaces of the base member have three said ribs that are upstanding ribs.

18. The cleaning implement according to claim 10 wherein the mop head axis is disposed at an oblique mop angle with respect to the longitudinal axis of the shaft.

19. The cleaning implement according to claim 10 wherein the integrally molded roller has a longitudinal dimension, and said ribs are disposed transversely to the longitudinal dimension.

20. The cleaning implement according to claim 19 wherein each of said rollers are integrally molded and include land areas extending in the longitudinal dimension, said land areas intersecting the transversely extending ribs and defining therebetween the cavities.

21. An integrally molded plastic roller for use in a cleaning implement including a shaft having an operator end and a cleaning end, a mop head comprising a liquid-absorbent member, and a wringing mechanism disposed at the cleaning end of the shaft, the mop head being movable relative to the wringing mechanism over a range of travel at least between a cleaning position and a plurality of wringing positions, the wringing mechanism in the wringing positions compressing at least a portion of the liquid-absorbent member whereby liquid is expellable therefrom and including a channel body for supporting at least one roller, which roller has a plurality of spaced ribs defining cavities therebetween and complementally shaped and dimensioned to be supported by the channel body and to allow rolling contact relative to the liquid-absorbent material as travel takes place between the cleaning position and the wringing positions wherein at least four ribs of the roller, together with a base member of the roller, provide an H-shaped configuration.

22. The roller according to claim 21 wherein said roller has a longitudinal dimension and said ribs are disposed in the longitudinal dimension.

23. The roller according to claim 21 wherein said ribs are dimensioned to allow penetration into the cavities by said liquid-absorbent material as travel takes place between the cleaning position and a wringing position.

24. The roller according to claim 21 wherein said base member has a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions.

25. The roller according to claim 24 wherein each end of the base member includes at least one said rib that is an end rib configured and dimensioned relative to the upstanding ribs on the top and bottom surfaces of said base member so as to facilitate a rolling action as travel takes place between the cleaning position to the plurality of wringing positions.

26. The roller according to claim 25 wherein the end ribs each have an outer dome-shaped surface contacting said liquid-absorbent material as travel takes place from the cleaning position to the plurality of wringing positions.

27. The roller according to claim 21 wherein the base member has top and bottom surfaces and each of the top and bottom surfaces of the base member have three said ribs that are upstanding ribs.

28. The roller according to claim 21 wherein the integrally molded roller has a longitudinal dimension, and said ribs are disposed transversely to the longitudinal dimension.

29. The cleaning implement according to claim 28 wherein said roller includes land areas extending in the longitudinal dimension, said land areas intersecting the transversely extending ribs and defining therebetween the cavities.

30. A cleaning implement comprising:

a shaft having an operator and a cleaning end, the operator end and the cleaning end defining a longitudinal axis;

a mop head comprising a liquid-absorbent member;

a wringing mechanism comprising an operator-gripping portion and a wringer, the wringer being disposed at the cleaning end of the shaft, the mop head being movable relative to the wringer over a range of travel at least between a cleaning position and a plurality of wringing positions, the wringing mechanism in the wringing position compressing at least a portion of the liquid-absorbent member whereby liquid is expellable therefrom; said wringer comprising at least one integrally molded plastic roller, and a channel body for supporting the roller, said integrally molded plastic roller having a plurality of spaced ribs defining cavities therebetween and complementally shaped and dimensioned to allow rolling contact relative to said liquid-absorbent material as travel takes place between the cleaning position and the wringing positions, said integrally molded plastic roller having a longitudinal dimension and said ribs being disposed in the longitudinal dimension, said ribs being dimensioned to allow penetration into the cavities by said liquid-absorbent material as travel takes place between the cleaning position and a wringing position, said roller comprising a base member having a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions, each end of the base member including an at least one said rib that is an end rib configured and dimensioned relative to the upstanding ribs on the top and bottom surfaces of said base member so as to facilitate a rolling action as travel takes place between the cleaning position to the plurality of wringing positions, the end ribs each having an outer dome-shaped surface contacting said liquid-absorbent material as travel takes place from the cleaning position to the plurality of wringing positions.

31. A cleaning implement comprising:

a shaft having an operator and a cleaning end, the operator end and the cleaning end defining a longitudinal axis;

a mop head comprising a liquid-absorbent member;

a wringing mechanism comprising an operator-gripping portion and a wringer, the wringer being disposed at the cleaning end of the shaft, the mop head being movable relative to the wringer over a range of travel at least between a cleaning position and a plurality of wringing positions, the wringing mechanism in the wringing position compressing at least a portion of the liquid-absorbent member whereby liquid is expellable therefrom; said wringer comprising a pair of plastic rollers, at least one of which is integrally molded, and a channel body for supporting the rollers in spaced relationship with each other such that a channel is defined therebetween, said integrally molded plastic roller having a plurality of spaced ribs defining cavities therebetween and complementally shaped and dimensioned to allow rolling contact relative to said liquid-absorbent material as travel takes place between the cleaning position and the wringing positions, both of said rollers being integrally molded, said ribs being dimensioned to allow penetration into the cavities by said liquid-absorbent material as travel takes place between the cleaning position and a wringing position, said rollers comprising a base member having a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions, each end of the base member including at least one said rib that is an upstanding rib configured and dimensioned relative to the upstanding ribs on the top and bottom surfaces of said base member so as to facilitate a rolling action as travel takes place between the cleaning position to the plurality of wringing positions, the end ribs each having an outer dome-shaped surface contacting said liquid-absorbent material as travel takes place from the cleaning position to the plurality of wringing positions.

32. An integrally molded plastic roller for use in a cleaning implement including a shaft having an operator end and a cleaning end, a mop head comprising a liquid-absorbent member, and a wringing mechanism disposed at the cleaning end of the shaft, the mop head being movable relative to the wringing mechanism over a range of travel at least between a cleaning position and a plurality of wringing positions, the wringing mechanism in the wringing positions compressing at least a portion of the liquid-absorbent member whereby liquid is expellable therefrom and including a channel body for supporting at least one roller, which roller has a plurality of spaced ribs defining cavities therebetween and complementally shaped and dimensioned to be supported by the channel body and to allow rolling contact relative to the liquid-absorbent material as travel takes place between the cleaning position and the wringing positions, said integrally molded plastic roller having a longitudinal dimension and said ribs being disposed in the longitudinal dimension, said ribs being dimensioned to allow penetration into the cavities by said liquid-absorbent material as travel takes place between the cleaning position and a wringing position, said roller comprising a base member having a top and bottom surface and ends and at least two said ribs that are upstanding ribs positioned on each of the top and bottom surfaces of the base member, said base member ends extending outwardly from each outermost rib and dimensioned to facilitate a rolling action as travel takes place between a cleaning position and the plurality of wringing positions, each end of the base member including at least one said rib that is an end rib configured and dimensioned relative to the upstanding ribs on the top and bottom surfaces of said base member so as to facilitate a rolling action as travel takes place between the cleaning position to the plurality of wringing positions, the end ribs each having an outer dome-shaped surface contacting said liquid-absorbent material as travel takes place from the cleaning position to the plurality of wringing positions.

* * * * *